United States Patent [19]

Ely et al.

[11] Patent Number: 4,796,884

[45] Date of Patent: Jan. 10, 1989

[54] CHILD'S PLAY SET WITH A LIFT SYSTEM

[75] Inventors: Donald B. Ely; Dale A. Ely, both of Richwood; Eric W. Anderson, Franklinville, all of N.J.

[73] Assignee: Loop Design, Inc., Richwood, N.J.

[21] Appl. No.: 13,235

[22] Filed: Feb. 10, 1987

[51] Int. Cl.[4] ..... A63B 17/00

[52] U.S. Cl. ..... 272/113; 52/292

[58] Field of Search ..... 272/1 A, 113; 52/292, 52/299; D21/242, 243, 244, 245, 246

[56] References Cited

U.S. PATENT DOCUMENTS

| | | | |
|---|---|---|---|
| D. 281,447 | 11/1985 | Gordon | D21/244 |
| 1,765,361 | 6/1930 | Berman | 272/113 |
| 2,010,890 | 8/1935 | Prince | 52/292 |
| 2,365,117 | 12/1944 | Stafford et al. | 272/112 |
| 2,929,627 | 3/1960 | Scanlon | 272/112 |
| 2,954,977 | 10/1960 | Durlacher | 272/113 |
| 3,339,920 | 9/1967 | Moritz | 272/113 |
| 3,407,548 | 10/1968 | Russell | 52/292 |
| 3,415,025 | 12/1968 | Walz, Jr. et al. | 52/299 |
| 3,750,349 | 8/1973 | Deike | 52/292 |
| 3,982,754 | 9/1976 | de Moreau | 272/113 |
| 4,262,900 | 4/1981 | Vinson | 272/113 |
| 4,348,843 | 9/1982 | Cairns et al. | 52/299 |
| 4,630,819 | 12/1986 | Levin | 272/113 |

FOREIGN PATENT DOCUMENTS

| | | | |
|---|---|---|---|
| 179249 | of 0000 | Fed. Rep. of Germany . | |
| 484155 | of 0000 | Fed. Rep. of Germany . | |
| 545325 | of 0000 | Italy . | |
| 782117 | 9/1957 | United Kingdom | 272/113 |

*Primary Examiner*—Mickey Yu
*Assistant Examiner*—Samuel Rimell
*Attorney, Agent, or Firm*—Thomas A. Lennox

[57] ABSTRACT

A child's play set including a playhouse type structure attached to a swing set is provided with a lift system including a four sided horizontal frame sized to match the foot print of the playhouse where the playhouse has no floor allowing the size of the play structure to be increased to suit larger children with porch structures resting on frame extensions to abut and hold the base of the playhouse between them on the lift structure with frame structures to raise the swing support members to match a height suitable for the larger children.

19 Claims, 3 Drawing Sheets

CHILD'S PLAY SET WITH A LIFT SYSTEM

BACKGROUND OF THE INVENTION

This invention relates to a climbing play set sometimes described as a "jungle gym" and specifically relates to a lift system to increase the size of a play set so that it is suitable for larger children.

One of the most effective toy investments that is long lasting in terms of healthy play value is the outdoor swing set and jungle gym type structures. These structures take the form of a play house or simply a box-like structure which includes various devices to aid the child in climbing up toward or to the top of the box shape. The box-like shape may include windows, ladders and doorways and may include a roof or an upper floor which may be reached by various ladder rung type structures built into the walls of the box-like structure. Swing sets generally include an upper horizontal swing support member with a pair of "A" frames structurally supporting each end of the horizontal swing support member. The swings hang from this horizontal swing support member in between the two frames.

The play systems described above can be constructed of durable materials and can last a long time. Unfortunately, children quickly grow out of play sets if they are constructed for the smallest of children. For example, a three year old, with all of his or her energy can easily spend hours of time on such play sets so long as the rungs and the climbing apparatus and the size of the structures are suited to the infant's size. However, when that infant grows in stature and is about six or seven years old or even older, the size of the play set suitable for the three year old is too small. For the older child, there is insufficient head room and there is little excitement climbing up on such a small structure. Further, the "windows" are suitable for a three year old, are now much too short for the taller child. Likewise, a swing that is suitable for a three or four year old holds little interest to a ten year old. It is not a satisfactory answer to the problem to design a swing set and climbing devices to suit the older children. Such a set will tend to otherwhelm the smaller children and they will be unable to achieve any significant play value from a "full-size" play set. It is well recognized that for smaller children, it is much more effective to "scale-down" the structure in order to allow them to fully participate in the use of the device. Unfortunately, the only ansewr, heretofore, was to discard the old small play set and purchase a new one of a suitable size, when the children grew up.

None of the prior play sets or structures have satisfied these needs and none have attained the objects described herein below for the present invention.

SUMMARY OF THE INVENTION

It is an object of the present invention to provide a play set that is capable of expansion upwardly to grow with the child's size.

It is an additional object of the present invention to provide a play set that includes a box-like structure, generally in the form of a play house with a lift system which will allow increase of the height of the box-like structure to more suitable size for larger children.

It is an additional object of the present invention to provide a lift system to increase the height of a play set that includes a box-like structure and a swing set such that the combination of the play set and the lift system provides a new play set suitable for larger children.

It is a particular object of the present invention to provide an attachment system which will safely and easily allow the attachment of a lift system to the prior play set.

The present invention is a play set that includes a box-like structure, preferably in the form of a play house. This box-like structure includes four walls, each having a base wood member that can rest on the ground together forming a foot print shape of the base members on the ground. The term "foot print" is the shape of the bottom surface of the elements of the box-like structure resting on the ground. The term "wall" is not intended to be limiting as to the structure and includes not only solid walls, but the more common foraminous structures of the typical play sets which are constructed of frames which provide many see-through apertures. It is important that the box-like structure have no floor, although it should be understood that the terminology of "no floor" limit includes structures where a floor is not attached to the box-like structure and rests directly on the ground. It is preferred that the base frame structure of the box-like structure have no cross members attached across the opening of the frame sufficiently to interfere with movement of the playing child after the box-like structure has been raised using the present invention. The box-like structure preferably has no floor at all such that children entering the box-like structure will stand directly on the ground. The height of the play set and specifically the box-like structure or play house is chosen to be suitable for the smallest of children allowing them at a young age to climb on the structure and not be overwhelmed by the size of it and afraid of the heights capable of being scaled. A lift system includes four vertically positioned rectangular frame structures of a height chosen to raise the box-like structure a sufficient distance to provide total interior and exterior heights suitable for larger size children. Throughout the specification the term "vertical frame" is intended to mean "vertically positioned rectangular frame". An attachment device is provided to fix the four vehicle frame structures into a four-sided horizontal frame of a size to match the foot print of the base wood members of the box-like structure. It is preferred that there be no cross members spanning across between the vertical structures of the horizontal frame so as to not interfere with movement within the raised structure. The box-like structure is lifted upwardly and placed on the four sided horizontal frame such that the base wood members rest on the upper surface of that horizontal frame. Preferably, on two of the vertical frame structures, added lengths are included so that these added lengths extend outwardly from the four-sided horizontal frame at each end generally forming a horizontal shape of the Roman Numeral Two (II). The preferred lift system also includes two porch member structures which are constructed to allow a person to stand on each porch member. The preferred lift system further includes two porch attachment devices to structurally fix the porch members on top of the added lengths of the vertical frame members to abut and hold the base members of the box-like structure between the porch members. It is preferred that the porch member structures have a width longer than the added lengths of the vertical frame structures such that when the porch structures are affixed to the four sided horizontal frame structure, the porch structures extend outwardly past the ends of the added lengths. It is further preferred that an outside frame member be included on the porch structure along the length of the porch structure and depending downwardly outside of the ends of the added lengths of the two larger vertical frame members leaving a space between the outside frame member and the ends of the added lengths. In this fashion, fasteners, preferably lag bolts, extend through these depended outside frame members to engage the ends of the added lengths of the two larger vertical frame members exerting a constant pressure from the porch structures against the base wood members of the box-like structure holding it in place.

A preferred play set and lift system includes a horizontal swing support member and two "A" frame structures supporting the swing support member at each end with each "A" frame structure having an "A" frame base member that can rest on the ground. The preferred play set also includes a horizontal support member structurally attached a tone end to the swing support member and at the other end to a top portion of the box like structure. This horizontal support member is preferably a ladder. The preferred lift system includes a pair of second vertical frame structures of the same height as the four vertical frame structures above and of a length to match the length of the "A" frame base members. The preferred lift system further includes an "A" frame attachment device to structurally attach the "A" frame base members to the second vertical frame structure. A preferred "A" frame attachment device includes two vertical members structurally attached to and extending vertically upwardly frame each of the second vertical frame structures and structurally attachable to the "A" frame structures.

BRIEF DESCRIPTIONS OF THE DRAWINGS

DESCRIPTION OF THE PREFERRED EMBODIMENTS

Figure 1:
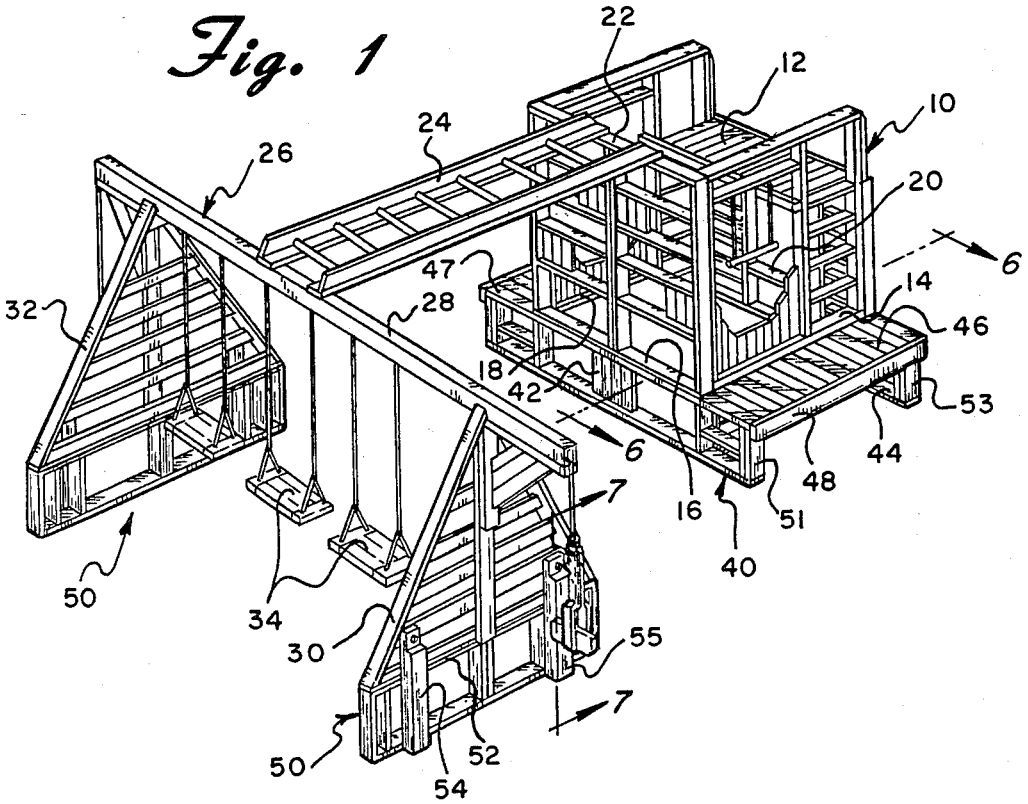
FIG. 1 is a perspective view of a play set of the present invention.

As illustrated in FIG. 1, box-like structure 10 generally in the form of a play house includes upper floor 12 and base wood members 14, 16, 18, and 20 which are constructed to rest on the ground when the lift system of the present invention is not being used. These four base members, generally in the shape of a square, form the "foot print", of box-like structure 10, that also includes upper structural horizontal member 22 on which ladder 24 is structurally attached extending outwardly toward swing play set 26 and is structurally attached to horizontal swing support member 28. "A" frame structures 30 and 32 support horizontal swing support member 28 at each end allowing swings 34 to hang down and swing freely. Lift system 40 includes four vertical frame structures, of which vertical frame structures 42 and 44 may be seen in this view. Porch structures 46 and 47 are structurally attached to the top of the added lengths of vertical frame structures 42 and 44. Outside porch frame member 48 is structurally attached to porch structure 46 depending downwardly and outside ends 51 and 53 of the added lengths of vertical frame structures 42 and 44. Swing lift structures 50 include vertical frame structure 52 and vertical attachment members 54 and 55 to support and structurally attach to "A" frames 30 and 32. Unless otherwise mentioned, the entire structure is made from 2 inch by 4 inch lumber attached together with nails, glue and lag bolts where appropriate.

Figure 2:
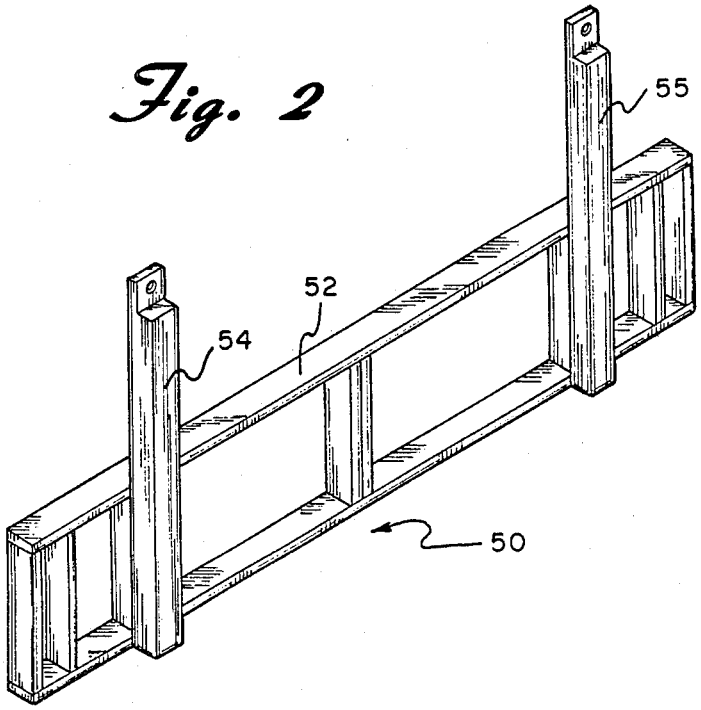
FIG. 2 is an expanded perspective view of a lift structure of the present invention to lift an "A" frame of the swing set.

In FIG. 2, swing lift system 50 is illustrated including second vertical frame 52 constructed of a height identical with that of a height as the lift system 40 and of a length equivalent to the base members, that can sit on the ground of "A" frames 30 and 32. Vertical attachment members 54 and 55 are structurally attached to frame 52 extending upwardly and attached through lag bolts to the structure of "A" frames 30 and 32.

Figure 3:
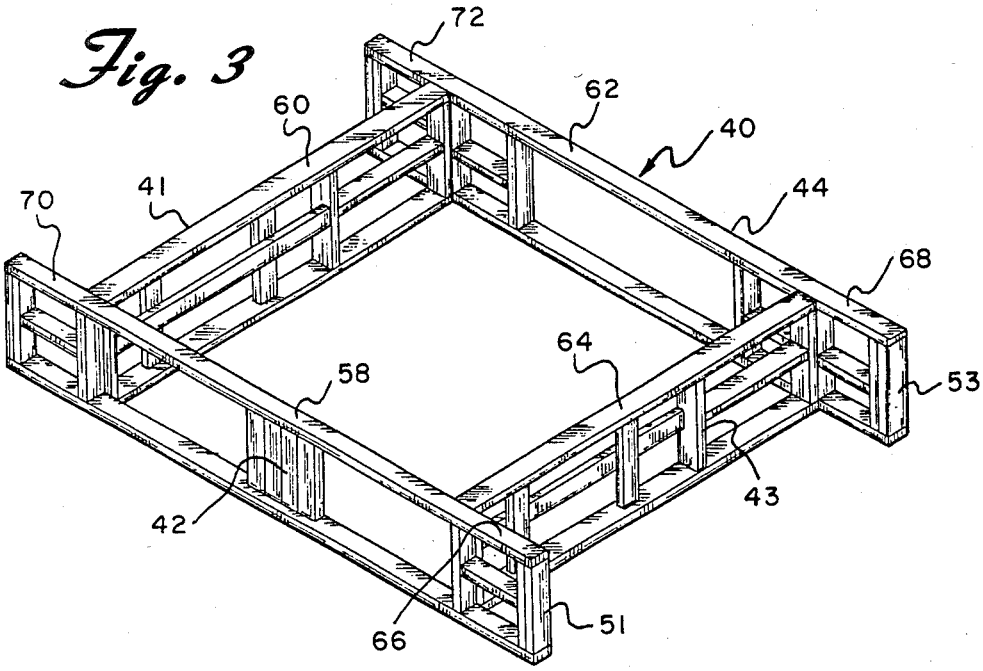
FIG. 3 is an expanded perspective view of a four sided horizontal frame structure lift system of the present invention.
Figure 4:
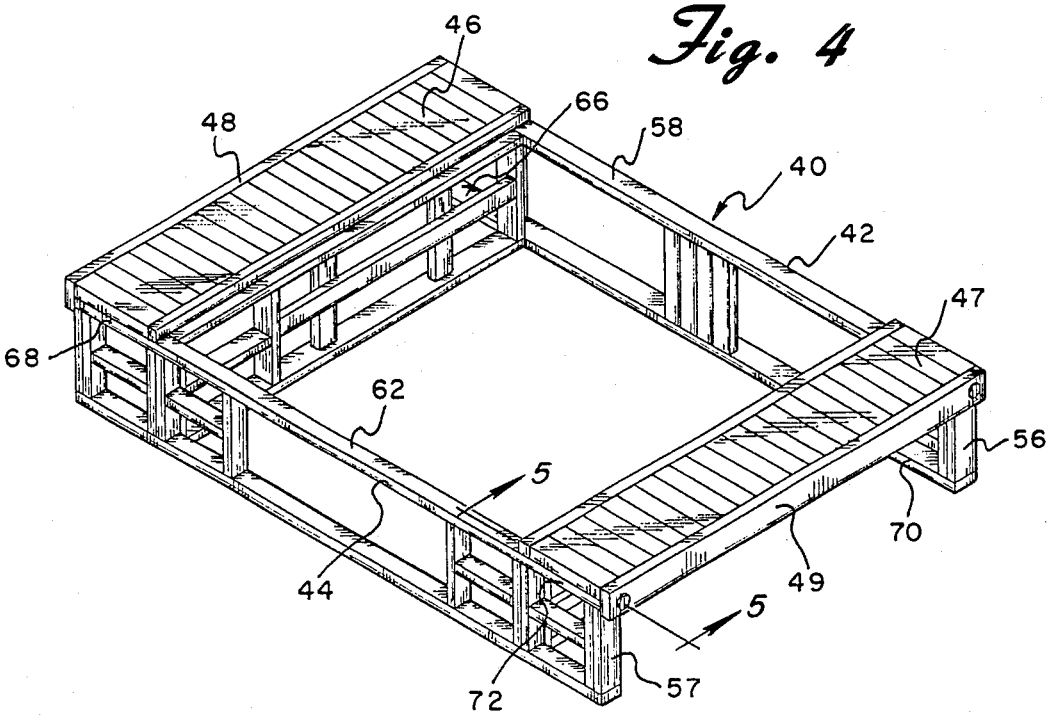
FIG. 4 is a perspective view illustrating the addition of porch like structures to the lift system illustrated in FIG. 3.
Figure 5:
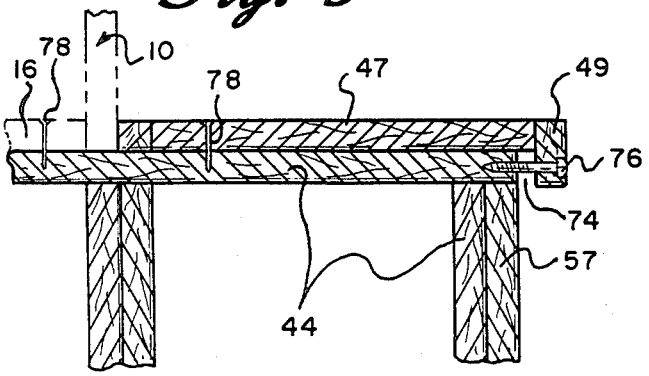
FIG. 5 is a vertical cross-sectional view taken along lines 5/5 of FIG. 4 illustrating the attachment of the porch structure and attachment of the lift system to the play set.
Figure 7:
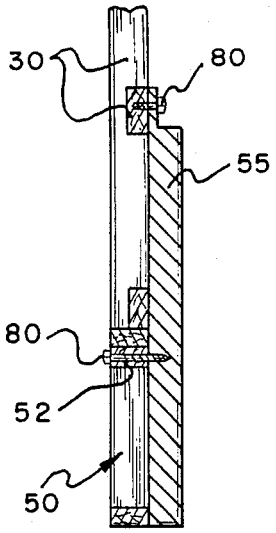
FIG. 7 is partial cross-sectional view taken along lines 7—7 of FIG. 1.
Figure 6:
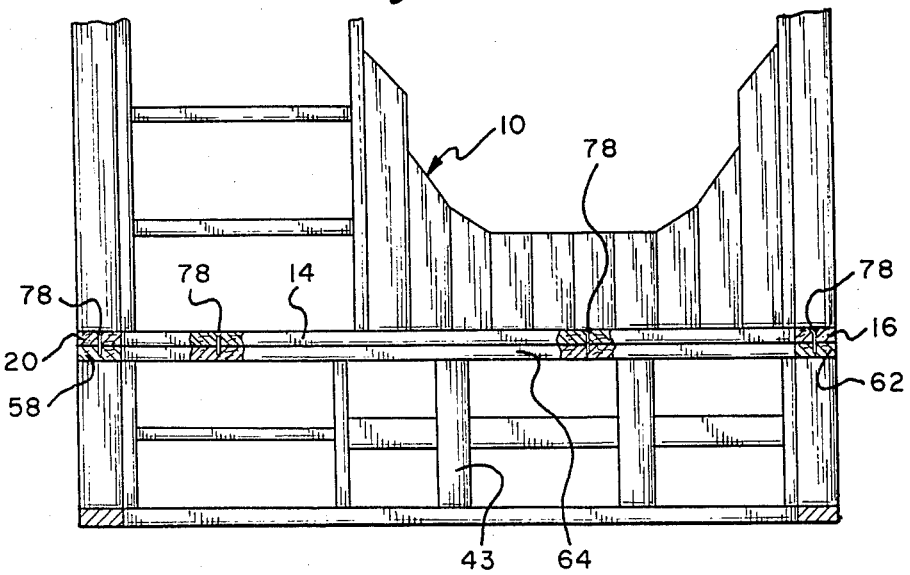
FIG. 6 is a vertical cross-sectional view taken along lines 6/6 of FIG. 1 illustrating the attachment of the lift system to the "A" frame of the swing set.

In FIG. 3, the lift device 40 is illustrated as constructed of vertical frame structures 41, 42, 43, and 44. Each of these vertical frame structures are constructed to a height which will raise house box structure 10 to a height suitable for larger children such that upper floor 12 will be above the heads of larger children and the apertures and climbing structures will be more appropriate for the larger child. Generally, this desirable increase in height is about two feet, so that each of the vertical frame structures is about two feet in height constructed of two by four members. The lengths of the vertical frame structures are chosen such that when attached together the top surfaces of the vertical frame members include surfaces that match the "foot print" of box-like structure 10. The term "foot print" is intended to describe the shape of the bottom surface of the box-like structure 10. It can be pictured as a line drawn on the ground around all of the elements resting on the ground, that shape being designated the "foot print". When the vertical frame structures are structurally attached to each other, they form a four sided horizontal frame with upper frame members 58, 60, 62 and 64 forming a shape to allow the base frame members 14, 16, 18 and 20 of structure 10 to rest on the lift system. Structure 10 has its base frame members resting on and supported by the upper frame members of lift system 40. Attachment between these members is usually sufficient to prevent any sliding or movement side to side and the preferred basic attachment system will be described herein below. In FIG. 4, porch structures 46 and 47 have been added and attached to lift system 40. As noted in FIG. 3, vertical frame structures 42 and 44 each have added lengths at each end extending outwardly from the four sided frame that matches the foot print of structure 10. Added lengths 66 and 68 extend in one direction as part of vertical frame structures 42 and 44 respectively while added lengths 70 and 72 extend in the opposite direction from vertical frame structures 42 and 44 respectively. Overall, a top view of lift structure 40 illustrated in FIG. 3 is generally in the form of Roman Numeral Two (II), also described as a two rung ladder shape. Porch structures 46 and 47 are structurally attached on top of the added lengths of the vertical frame structure. Thus, porch structure 46 rests on the top of added lengths 66 and 68 and porch structure 47 rests on the top of added lengths 70 and 72. These porch structures are not only nailed directly to the tops of the extra lengths of the vertical frame structures, but are first attached by lag bolts or like fasteners. Lag bolts or like fasteners extend through outside frame members 48 and 49 into the ends of the vertical frame structures. As illustrated in FIG. 5, porch structure 47 fits on the top of added lengths 66 and 68. Porch structure 47 abuts against base frame member 18 of structure 10 (see FIG. 1) and the ends of base members 16 and 20 of structure 10. Outside frame member 48 extends along the entire length of porch structure 47 and is structurally attached thereto. Member 28 depends downwardly outside of ends 56 and 57 of added lengths 70 and 72 respectively. The width of porch structures 46 and 47 are longer than the added lengths of the vertical frame structures on which they rest so that outside frame members 48 and 49 depending downwardly do not abut the ends of the vertical frame structure. As specifically illustrated in FIG. 5, space 74 is left between outside frame member 49 and end 57 such that when lag bolt 76 is fixed through outside frame member 49 and into end 57 of vertical frame structure 44, constant force is exerted from porch structure 47 against the base of house structure 10 and specifically against base frame member 18 (See FIG. 1). This force holds structure 10 in place. With the addition of nails 78 through base frame member 16, structure 10 is effectively held in place on top of lift system 40. As further illustrated in FIG. 6, nail attachments 78 are used to attach the base frame members to the upper frame members of lift system 40, but a major force holding the structure in place is obtained by the pressure by porch structures 46 and 47 against the base of structure 10. The cross-sectional view of FIG. 7 shows frame structure 30 is fixed to base structure 30 through the attachment with lag bolts 80 through vertical attachment member 55 which provides support for the structural attachment.

While this invention has been described with reference to the specific embodiments disclosed herein, it is not confined to the details set forth and the patent is intended to include modifications and changes which may come within and extend from the following claims.

We claim:

1. A play set comprising:

(a) a box-like structure with four walls each having a base wood member that together form a foot print that can rest on the ground wherein the box-like structure has no floor attached to it and no cross members spanning between the base members, wherein the height of the box-like structure is suitable for small children, and (b) a lift system comprising:

(i) four vertically positioned rectangular frame structures of a height chosen to raise the box-like structure a sufficient distance to provide a total interior height suitable for larger size children, and (ii) attachment means to fix the four vertically positioned rectangular frame structures into a four sided horizontal frame of a size to match the footprint of the base wood members of the box-like structure, wherein there are no cross members spanning the horizontal frame.

2. The play set of claim 1 wherein the lift system further comprises:

(a) added lengths of two of the vertically positioned rectangular frame structures from each end to form two longer vertically positioned rectangular frame structures so that the added lengths of the two longer vertically positioned rectangular frame structures extend outwardly from the horizontal frame forming a horizontal shape of a Roman Numeral two, (b) two porch structures constructed to allow a person to stand on the porch member, and (c) two porch attachment means to structurally fix the porch members on top of the added lengths of the vertically positioned rectangular frame members and abut and hold the base wood members of the box-like structure between the porch members.

3. The play set of claim 2 wherein the porch structures have a width longer than the added lengths such that when the porch structures are attached to the four sided horizontal frame the porch structures extend outwardly past the ends of the added lengths.

4. The play set of claim 3 wherein each of the porch structures further comprise an outside frame member along the length of the porch structure depending downwardly outside the ends of the added lengths of the two longer vertically positioned rectangular frame members, leaving a space between the outside frame member and the ends of the added lengths.

5. The play set of claim 1 wherein the box-like structure includes an upper floor and a ladder structure to allow a child to climb up to the upper floor.

6. The play set of claim 1 wherein the box-like structure is a play house.

7. The play set of claim 1 wherein the play set further comprises a play swing set of a horizontal swing support member and two "A" frame structure supporting the swing support member at each end with each "A" frame structures having an "A" frame base member that can rest on the ground and a horizontal support member structurally attached at one end to the swing support member and at the other end to a top portion of the box-like structure, and the play set further comprises:

(a) a pair of second vertically positioned rectangular frame structures of the same height as the four vertically positioned rectangular frame structures and of a length to match the length of the "A" frame base members, and (b) "A" frame attachment means to structurally attach the "A" frame base members to a top member of the second vertically positioned rectangular frame structures.

8. The play set of claim 7 wherein the box-like structure is a play house that includes an upper floor and a ladder structure to allow a child to climb up to the upper floor.

9. The play set of claim 8 wherein the horizontal support member is a horizontal ladder structure that can be reached from the upper floor.

10. The play set of claim 7 wherein the "A" frame attachment means comprises two vertical members structurally attached to and extending vertically upwardly from each of the second vertically positioned rectangular frame structures and structurally attachable to the "A" frame structures.

11. A lift system for a play set that includes a box-like structure with four walls each having a base wood member that together form a foot print that can rest on the ground, wherein the box-like structure has no floor, attached to it and wherein the height of the box-like structure is suitable for small children, the lift system comprising:

(a) four vertically positioned rectangular frame structures of a height chosen to raise the box-like structure a sufficient distance to provide a total interior height suitable for larger size children, (b) attachment means to fix the four verticallly positioned rectangular frame structures into a four sided horizontal frame of a size to match the footprint of the base wood members of the box-like structure, (c) added lengths of two of the vertically positioned rectangular frame structure from each end to form two longer vertically positioned rectangular frame structures, so that the added lengths of the two longer vertically postioned frame structures extend outwardly from the horizontal frame at each end forming a horizontal shape of a Roman Numeral two, (d) two porch structures constructed to allow a person to stand on the porch member, and (e) two porch attachment means to structurally attach the porch members on top of the added lengths of the vertically positioned rectangular frame structures and abut and hold the base wood members of the box-like structure between the porch structures.

12. The lift system of claim 11 wherein the porch structures have a width longer than the added lengths such that when the porch structures are fixed to the four sided horizontal frame the porch structures extend outwardly past the ends of the added lengths.

13. The lift system of claim 12 wherein each of the porch structures further comprise an outside frame member along the length of the porch structure depending downwardly outside the ends of the added lengths of the two larger vertically positioned rectangular frame members, leaving a space between the outside frame member and the ends of the added lengths.

14. The lift system of claim 11 wherein the box-like structure includes an upper floor and a ladder structure to allow a child to climb up to the upper floor.

15. The lift system of claim 11 wherein the box-like structure is a play house.

16. The system of claim 11 wherein the play set further includes a play swing set of a horizontal swing support member and two "A" frame structures supporting the swing support member at each end with each "A" frame structures having an "A" frame base member that can rest on the ground and a horizontal support member structurally attached at one end to the swing support member at the other end to a top portion of the box-like structure, the lift system further comprising:

(a) a pair of second vertically positioned rectangular frame structures of the same height as the four vertically positioned rectangular frame structures and of a length to match the length of the "A" frame base members, and (b) "A" frame attachment means to structurally attach the "A" frame base members to a top member of the second vertically positioned rectangular frame structures.

17. The lift system of claim 16 wherein the box-like structure is a play house that includes an upper floor and a ladder structure to allow a child to climb up to the upper floor.

18. The lift system of claim 17 wherein the horizontal support member is a horizontal ladder structure that can be reached from the upper floor.

19. The lift system of claim 16 wherein the "A" frame attachment means comprises two vertical members structurally attached to and extending vertically upwardly from each of the second vertically positioned rectangular frame structures and structurally attachable to the "A" frame structures.

* * * * *

UNITED STATES PATENT AND TRADEMARK OFFICE

CERTIFICATE OF CORRECTION

PATENT NO. : 4,796,884

DATED : January 10, 1989

INVENTOR(S) : DONALD B. ELY ET AL

It is certified that error appears in the above-identified patent and that said Letters Patent is hereby corrected as shown below:

Title page:

Item [75] should read --Donald B. Ely, Waterford, Conn., Dale A. Ely, Richwood, N. J.; Eric W. Anderson, Franklinville, N. J. --.

Item [73] should read --Coop Design, Inc., Richwood, N. J. --.

Signed and Sealed this

Twenty-seventh Day of June, 1989

*Attest:*

*Attesting Officer*

DONALD J. QUIGG

*Commissioner of Patents and Trademarks*